US007018681B2

(12) United States Patent
Liu et al.

(10) Patent No.: US 7,018,681 B2
(45) Date of Patent: Mar. 28, 2006

(54) REDUCING UV PROCESS TIME ON STORAGE MEDIA

(75) Inventors: Jianwei Liu, Fremont, CA (US); Michael J. Stirniman, Fremont, CA (US); Jing Gui, Fremont, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 307 days.

(21) Appl. No.: 10/317,653

(22) Filed: Dec. 12, 2002

(65) Prior Publication Data

US 2003/0195127 A1 Oct. 16, 2003

Related U.S. Application Data

(60) Provisional application No. 60/368,727, filed on Mar. 29, 2002.

(51) Int. Cl.
*G11B 5/725* (2006.01)
*C08F 8/00* (2006.01)

(52) U.S. Cl. ..... 427/508; 427/517; 427/553; 427/554; 427/130; 427/131

(58) Field of Classification Search ..... 427/130, 427/131, 508, 517, 553, 554
See application file for complete search history.

(56) References Cited

U.S. PATENT DOCUMENTS

| | | | | |
|---|---|---|---|---|
| 4,681,925 | A * | 7/1987 | Strepparola et al. | 526/246 |
| 5,409,738 | A | 4/1995 | Matsunuma et al. | |
| 5,741,577 | A | 4/1998 | Yamamoto et al. | |
| 6,071,609 | A * | 6/2000 | Furutani et al. | 428/332 |
| 6,120,922 | A | 9/2000 | Goto | |
| 6,316,062 | B1 | 11/2001 | Sakaguchi et al. | |

* cited by examiner

*Primary Examiner*—Stevan A. Resan
(74) *Attorney, Agent, or Firm*—Morrison & Foerster LLP

(57) ABSTRACT

A perfluoropolyether hard disk lubricant having a UV curable functional end group that may be UV cured at a rapid rate with a Xenon excimer lamp. The perfluoropolyether preferably has at least one UV curable functional end group. In one embodiment, the UV curable end group comprises an acrylate.

8 Claims, 1 Drawing Sheet

REDUCING UV PROCESS TIME ON STORAGE MEDIA

CROSS-REFERENCE TO RELATED APPLICATIONS

This application claims benefit of U.S. Provisional patent application Ser. No. 60/368,727, filed on Mar. 29, 2002, which is hereby incorporated by reference.

BACKGROUND OF THE INVENTION

1. Field of the Invention

The invention relates to field of disk drives and more particularly to magnetic disk lubricants.

2. Description of the Related Art

Hard disk drives record data on hard, rotating magnetic disks. A hard disk typically comprises a hard substrate upon which are deposited one more or thin films that are used to record and retain the data in the form of magnetic domains. These magnetic domains in turn generate magnetic flux in a predetermined direction that can be sensed by sensors of various kinds including so-called magnetoresistive sensors. In a hard disk drive, the magnetic sensor is caused to fly very close to the magnetic disk—so close that intermittent contact can be expected. As a result the magnetic recording layers are typically covered with a carbon overcoat layer that is in turn lubricated with a lubricant.

These lubricants reduce stiction and friction between the head and the carbon overcoat. They also fill in microscopic gaps in the carbon overcoat to protect the magnetic alloy from corrosion. However, the lubricants typically used in hard disk drives degrade over time leading at times to disk drive failure either because of carbon overcoat wear or because of corrosion.

It has recently been discovered that the use of ultraviolet light to "cure" these lubricants improves both the reliability and tribological performance of the lubricant. Lubricant performance increases until a certain UV dosage has been reached, after which there is no further improvement in lubricant performance. In a particular example, this "saturation" level is reached in approximately 3 minutes of exposure in a system where Fomblin® Z-DOL, available from Ausimont USA, with an X1P additive, available from the Dow Chemical Company, is exposed to a mercury discharge UV lamp at a power density of 35 milliwatts per square cm.

However, this exposure time is excessively long in the manufacture of hard disks. Improvements in process time are required to make UV exposure practicable in the manufacture of magnetic hard disks.

SUMMARY OF THE INVENTION

The invention comprises a perfluoropolyether hard disk lubricant having a UV curable functional end group that may be UV cured at a rapid rate. The perfluoropolyether preferably has at least one UV curable functional end group. In one embodiment, the UV curable end group comprises an acrylate. The acrylated perfluoropolyether lubricant has the general formula:

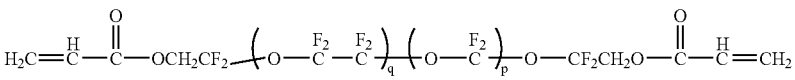

In a further aspect of present invention, the lubricant is cured by exposing a lubricated disk to an UV light having a wavelength of approximately 172 nm wavelength and a power density of 10 mW per square centimeter for a time sufficient for the lubricant properties to stabilize.

IF BRIEF DESCRIPTION OF THE DRAWINGS

DETAILED DESCRIPTION OF THE PREFERRED EMBODIMENTS

A conventional lubricant commonly used in hard disk drives is a functionalized perfluoropolyether such as Fomblin® Z-DOL, available from Ausimont USA. The formula for Z-DOL having two $CH_2OH$ functional end groups is

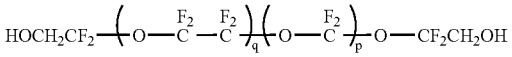

This lubricant is typically fractionated by individual hard disk media companies. The typical molecular weight of Z-DOL used in hard disk drive disks ranges from 1000 to 8000 Daltons.

Most hard disk manufacturers also add a small amount of X-1P to the main lubricant in order to provide corrosion protection. X-1P is available from the Dow Chemical Company. It has the formula

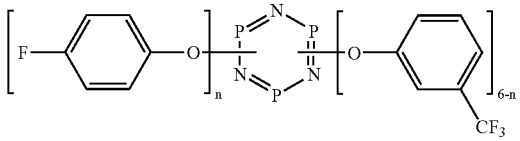

n = 0–6

DOW Chemical X-1p (cyclotriphosphazene lubricant)

Recently it was discovered that irradiating this lubricant with UV light from a mercury discharge lamp would increase the lubricant's performance. In particular, the lubricant's water contact angle, i.e., the contact angle of a droplet of water on the disk surface (which increases as surface energy decreases), and the bonded lubricant thickness increases. "Bonded lubricant" is the thickness of the lubricant after a disk is exposed to vapor of lube solvents, such as Vetrel, which removes the lubricant not bonded to the disk surface in some manner. The effect levels off after a certain dosages has been reached. This "saturation" level is typically reached with Z-DOL/X-1p after more than three minutes of exposure when the disk is irradiated with a mercury-vapor (254/185 nm) lamp with a power density of 35 milliwatts/$cm^2$.

This reaction time is relatively slow and its slowness raises the cost of applying this technique in the manufacture of hard disk drives. A first technique according to present invention to increase reaction times is to reduce the wavelength of the UV light. The exact wavelength that generates the best performance in a particular environment and lubricant is left skilled designer. However, with the Z-DOL/X-1p lubricant, applicants have found that a wavelength of 172 nm is preferred. UV light with this wavelength is produced by an xenon excimer lamp available from such companies as Resonance LTD of Barrie, Ontario Canada.

Figure 1:
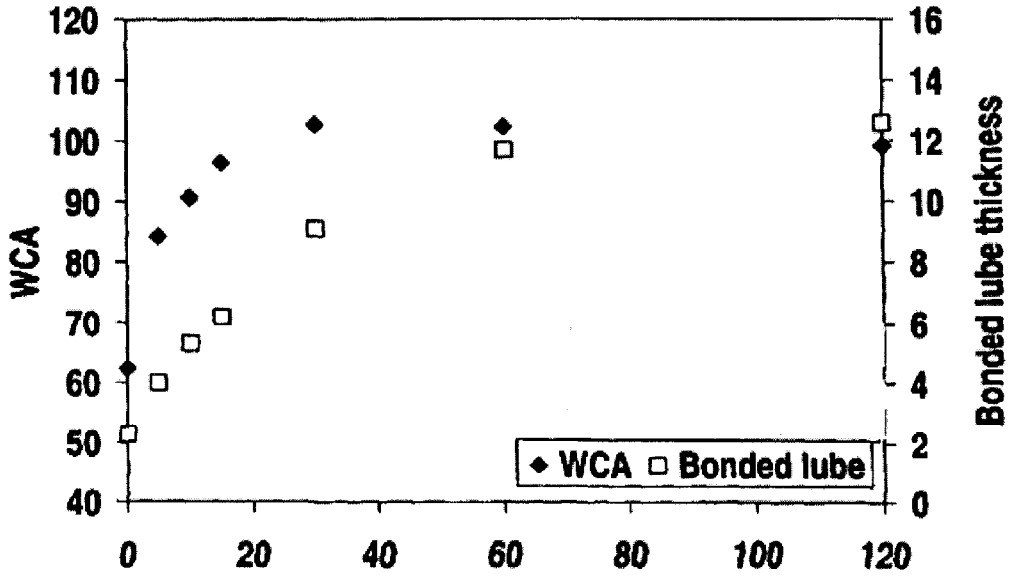
FIG. 1 is a chart of water contact angle and bonding lubricant thickness vs. irradiation time for a standard Z-DOL lubricant.

FIG. 1 presents data concerning both the water contact angle and the bonded lubricant thickness measure of lubricant performance vs. irradiation time where a conventional Z-DOL/X-1p lubricated disk was irradiated with a 172 nm UV source at a power density of 10 milliwatts per square centimeter. The chart illustrates that effective saturation occurs between 60 and 120 seconds. This is at least one minute less than time it takes when a conventional mercury-vapor lamps is used.

The applicants have further found that adding a UV curable end group to the main lubricant further dramatically decreases the time to saturation. Applicants have found that the following UV curable compounds work with Z-DOL: acrylate, methacrylate, styrene, a-methyl styrene and vinyl ester.

Figure 2:
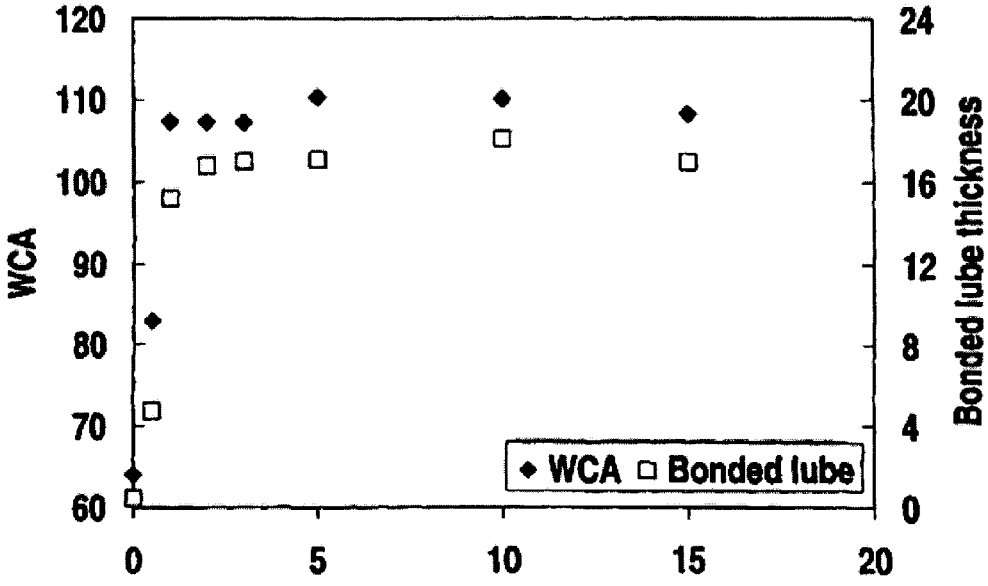
FIG. 2 is a chart of water contact angle and bonding lubricant thickness vs. irradiation time for an acrylated Z-DOL lubricant.

FIG. 2 presents data concerning both the water contact angle and the bonded lubricant thickness measure of lubricant performance vs. irradiation time where an acrylated Z-DOL/X-1p lubricated disk was irradiated with a 172 nm UV source at a power density of 10 milliwatts per square centimeter. The chart illustrates that effective saturation occurs at around two seconds. This is about two orders of magnitude less than time it takes when a conventional mercury-vapor lamps is used with a conventional lubricant.

This important to note here that when the same acrylated Z-DOL/X-1p lubricated disk was irradiated with a conventional mercury-vapor lamp nm that operates with a wavelength of 254/185 (nm) at 35 milliwatts per square centimeter for her to a, the saturation time was between one and two minutes. This illustrates that the combination of both a 172 nm UV source and a UV curable end group leads to the dramatic reduction in saturation time.

When conducting irradiation with ultraviolet light at 172 nm, the irradiation must take place in a chamber where gas is introduced prevent formation of ozone. If a nitrogen purge is not introduced, the UV light will react with oxygen to form ozone. Ozone can oxidize the carbon overcoat and lubricants under UV exposure. This leads to degrading lubricant performance. Moreover, a high ozone content can etch metal and plastic equipment parts. It is also a hazard to operators.

Nitrogen is the cheapest ozone purging gas. Helium, Argon, etc., can also be used. However, they are too expensive for practical application. For the same reason, a high vacuum exposure environment is not practical for reasons of cost.

The UV curable end group may be added to Z-DOL by reacting it with Acrylic chloride in the following reaction:

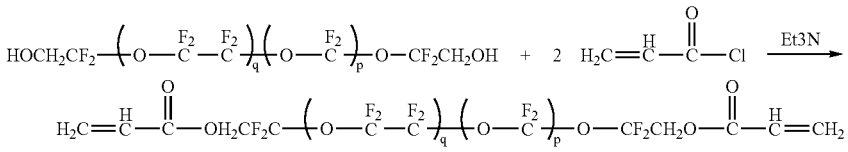

The perfluoropolyether precursors in the reaction are supercritical fluid extraction fractions from Ausimont Fomblin® Z-DOL. The molecular weight of Z-DOL ranges from 1000 to 8000 Daltons. The q to p ratio is between 0.5 to 1.5. Acrylic chloride is commercially available. 1 eq. of Zdol reacts with 1 eq. of acrylic chloride in 1.05 eq. of $Et_3N$ at room temperature. After stirring for 1 hr, a standard workup followed by vacuum distillation gives a clear oil.

In addition to an acrylate functional group, other polymerizable functional groups including methacrylate, vinyl ester and 4-vinylbenzylate can also serve the purpose of providing a UV-curable functional end group.

Those of ordinary skill may vary the particular ultraviolet wavelengths and UV-curable end groups according to the specific application which includes lubricant other than Z-DOL without varying from the scope of the invention as defined in the appended claims.

We claim:

1. A method of treating a lubricated hard disc, comprising:

inserting the lubricated hard disc in a chamber, the lubricated hard disc comprising a lubricant comprising a UV curable functional group;

irradiating the lubricated hard disc with UV excimer light for a time to create effective saturation of water contact angle; and purging the chamber with a gas to prevent formation of ozone in the chamber, wherein the time to create effective saturation of water contact angle of the lubricant irradiated with UV excimer light is about two orders of magnitude less than a time for effective saturation of water contact angle of a conventional lubricant irradiated with light from a mercury-vapor lamp, the conventional lubricant having a formula:

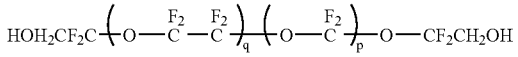

wherein q and p are repeat units in the formula.

2. The method of claim 1, wherein the UV excimer light has a wavelength of approximately 172 nm.

3. The method of claim 1 wherein the time to create effective saturation of water contact angle of the lubricant irradiated with UV excimer light is sufficient for lubrication properties of the lubricant to stabilize such that further dosage does not substantially change the water contact angle of the lubricant.

4. The method of claim 1 wherein said lubricant comprises a perfluoropolyether having a UV curable functional end group.

5. The method of claim 1 wherein said lubricant comprises a perfluoropolyether having a UV curable functional end group wherein the UV curable functional end group is selected from a group consisting of acrylate, methacrylate, vinyl ester and 4 vinylbenzylate.

6. The method of claim 1 wherein said lubricant comprises a perfluoropolyether having a UV curable functional end group wherein said perfluoropolyether compound has one or more functional end groups in addition to the UV curable functional end group.

7. The method of claim 1 wherein said time for effective saturation of water contact angle of a conventional lubricant irradiated with light from a mercury-vapor lamp is between 60 seconds and 120 seconds.

8. The method of claim 1 wherein said time to create effective saturation of water contact angle of the lubricant irradiated with UV excimer light is about 2 seconds.

* * * * *